US012274335B2

(12) United States Patent
Amundson

(10) Patent No.: US 12,274,335 B2
(45) Date of Patent: Apr. 15, 2025

(54) RING-POSITIONING PENDANT

(71) Applicant: Kevin Amundson, Nashville, TN (US)

(72) Inventor: Kevin Amundson, Nashville, TN (US)

( * ) Notice: Subject to any disclaimer, the term of this patent is extended or adjusted under 35 U.S.C. 154(b) by 17 days.

(21) Appl. No.: 18/320,277

(22) Filed: May 19, 2023

(65) Prior Publication Data

US 2023/0371661 A1 Nov. 23, 2023

Related U.S. Application Data

(60) Provisional application No. 63/365,083, filed on May 20, 2022.

(51) Int. Cl.
*A44C 15/00* (2006.01)
*A44C 17/02* (2006.01)

(52) U.S. Cl.
CPC ..... *A44C 15/003* (2013.01)

(58) Field of Classification Search
CPC ... A44C 15/003; A44C 13/00; A44C 15/0055; A44C 17/0208; A44C 25/001; A44C 11/00; A44C 9/00; A44C 25/00; Y10T 24/1397; A45C 11/16
USPC ..... 63/1.16, 18, 19, 40; 206/6.1
See application file for complete search history.

(56) References Cited

U.S. PATENT DOCUMENTS 1,141,992 A 9/1914 Ring-Holder
2,954,593 A 10/1958 Holders
3,192,737 A 7/1965 Smith
4,220,017 A 9/1980 Freeman
D272,609 S 2/1984 Ofiesh, II
4,516,708 A 5/1985 Elliott
4,726,200 A 2/1988 Carter
5,758,516 A * 6/1998 Uematsu ..... A44C 25/001 63/23
5,806,346 A 9/1998 Schlinger
8,707,731 B2 4/2014 Graves Crittenden
8,752,743 B2 6/2014 Nazarenko
D751,453 S 3/2016 Baltich
11,766,099 B2 * 9/2023 Russel ..... A44C 25/001 63/1.11
2003/0126887 A1 1/2003 Rings
2006/0042313 A1 3/2006 Mattiacci
2006/0185393 A1 8/2006 Cherry
(Continued)

FOREIGN PATENT DOCUMENTS

JP 54115295 U * 1/1978
JP 08294407 A * 11/1996
(Continued)

*Primary Examiner* — Jack W Lavinder

(57) ABSTRACT

A wearable jewelry holder including a main body with a front surface, a back surface, and a jewelry through hole extending through the main body from the front surface to the back surface. The jewelry through hole is configured to receive a jewelry item therethrough. The wearable jewelry holder further includes a first bracing member connected to the back surface and defining a first chain through hole, and a second bracing member connected to the back surface and defining a second chain through hole. The main body and the bracing members are collectively configured to hold the jewelry item upon insertion of the jewelry item in the jewelry through hole and insertion of a wearable chain through the first chain through hole, a through hole of the jewelry item, and the second chain through hole.

20 Claims, 11 Drawing Sheets

(56) References Cited

U.S. PATENT DOCUMENTS

| | | | |
|---|---|---|---|
| 2012/0118924 | A1 | 5/2012 | Barone |
| 2013/0104600 | A1 | 5/2013 | Graves Crittenden |
| 2019/0191830 | A1 | 6/2019 | Ruiz |

FOREIGN PATENT DOCUMENTS

| | | | | |
|---|---|---|---|---|
| JP | 3132887 | U | * | 4/2007 |
| JP | 2015071025 | A | * | 4/2015 |
| JP | 2017202067 | A | * | 11/2017 |

* cited by examiner

RING-POSITIONING PENDANT

CROSS-REFERENCE TO RELATED APPLICATIONS

This application claims benefit of U.S. provisional patent application Ser. No. 63/365,083, entitled "RING-POSITIONING PENDANT", filed May 20, 2022, which is herein incorporated by reference in its entirety.

BACKGROUND

The present disclosure relates to accessories for jewelry. More specifically, the present disclosure relates to a holder for holding and showcasing a ring.

Sometimes a ring owner does not wish to wear a ring around his finger, and instead he will wear the ring on a chain around his neck like a necklace. For example, the wearer may worry about losing the ring, the ring may not fit properly, the wearer may work with his hands, or the ring may be uncomfortable to wear so ultimately the wearer decides to wear the ring like a necklace instead of around his finger. When the ring is worn on a chain, the top of the ring, which holds the gemstone, faces downward due to gravity. As can be appreciated, a downwardly facing ring is not aesthetically pleasing. When the ring rests on a necklace in a downward position, or at a downwards angle, the top of the ring cannot be fully appreciated by others. Furthermore, such a downward position of the ring may be uncomfortable. For instance, the gemstone and/or the gemstone holding members at the top of the ring may uncomfortably contact the wearer and cause skin irritation. Additionally, the ring may become damaged or otherwise undesirably contact the wearer and/or foreign objects as it tends to move about the chain and generally flop around since there is no clamp or holder that fixes the ring to the chain at a particular location.

Conventional wearable ring holders are useful in mounting and fixing the ring at a particular location of the chain. For example, some conventional ring holders include a latching mechanism for preventing the ring from sliding relative to the chain. However, conventional ring holders let the ring fall forwardly and downwardly. Also, conventional ring holders are cumbersome to use and uncomfortable to wear.

SUMMARY

In one exemplary embodiment, there is provided a wearable jewelry holder. The wearable jewelry holder includes a main body with a front surface, a back surface, and a jewelry through hole extending through the main body from the front surface to the back surface. The jewelry through hole is configured to receive a jewelry item therethrough. The wearable jewelry holder further includes a first bracing member connected to the back surface and defining a first chain through hole, and a second bracing member connected to the back surface and defining a second chain through hole. The main body and the bracing members are collectively configured to hold the jewelry item upon insertion of the jewelry item in the jewelry through hole and insertion of a wearable chain through the first chain through hole, a through hole of the jewelry item, and the second chain through hole.

In another exemplary embodiment, there is provided a wearable ring holder. The wearable ring holder includes a main body with a front surface, a back surface, and a ring through hole extending through the main body from the front surface to the back surface. The ring through hole configured to receive a shank of a ring therethrough. The wearable ring holder further includes a first bracing member connected to the back surface and defining a first chain through hole, and a second bracing member connected to the back surface and defining a second chain through hole. The main body and the bracing members are collectively configured to hold the ring upright upon insertion of the ring in the ring through hole and insertion of a wearable chain through the first chain through hole, a finger through hole of the ring, and the second chain through hole.

In yet another exemplary embodiment, there is provided a method for showcasing a ring. The method includes an initial step of providing a ring with a finger through hole, a wearable chain, and a wearable ring holder. The wearable ring holder includes a main body having a front surface, a back surface, and a ring through hole extending through the main body from the front surface to the back surface, a first bracing member connected to the back surface and defining a first chain through hole, and a second bracing member connected to the back surface and defining a second chain through hole. The method also includes inserting the ring into the ring through hole such that a shank of the ring extends therethrough. The method also includes inserting the chain through the first chain through hole, the finger through hole of the ring, and the second chain through hole such that the main body and the bracing members collectively hold the ring.

BRIEF DESCRIPTION OF THE DRAWINGS

The embodiments illustrated herein are not limited to the precise arrangements, sequential steps, and dimensions shown. Like numerals indicate like elements throughout the drawings. In the drawings.

DETAILED DESCRIPTION

Figure 2:
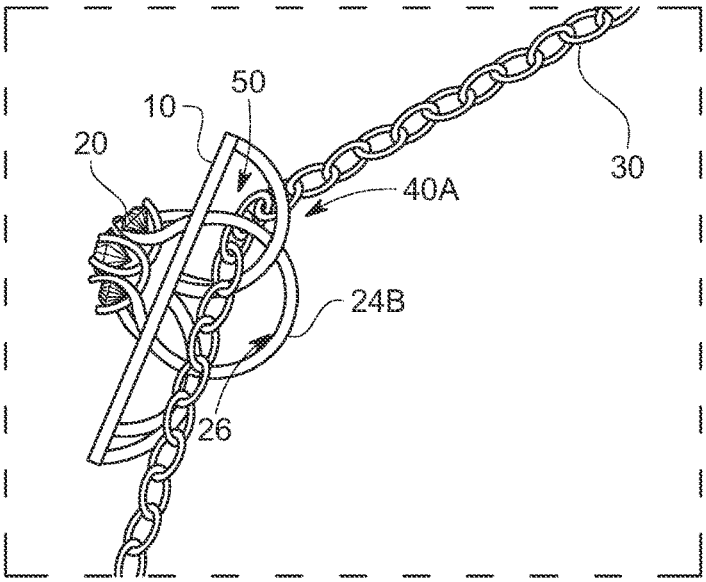
FIG. 2 a side perspective view of the ring holder of FIG. 1.
Figure 3:
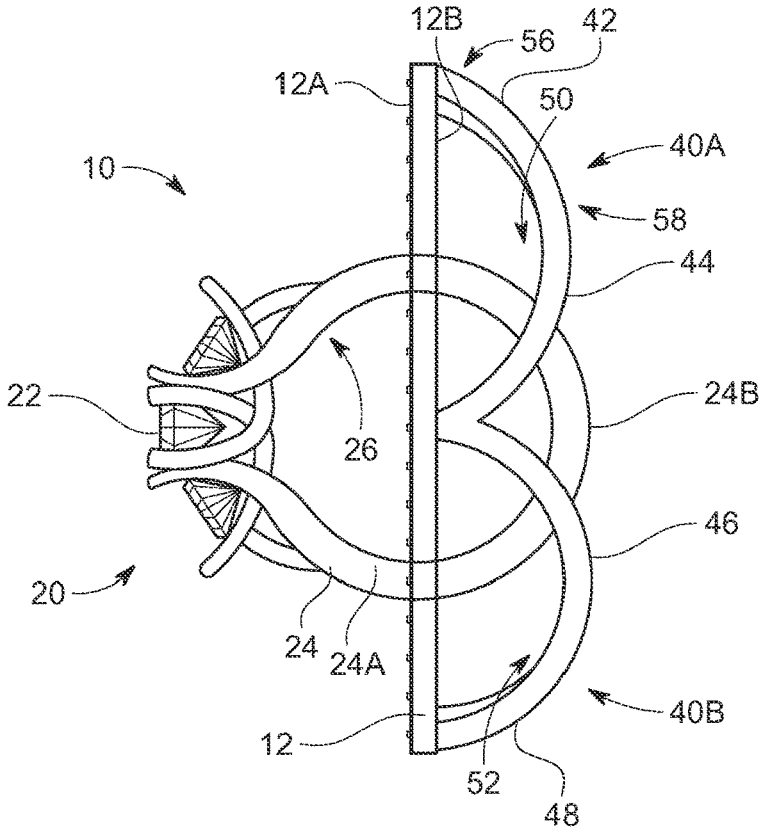
FIG. 3 is a side view of the ring holder of FIG. 1, with the ring disposed therein.
Figure 4:
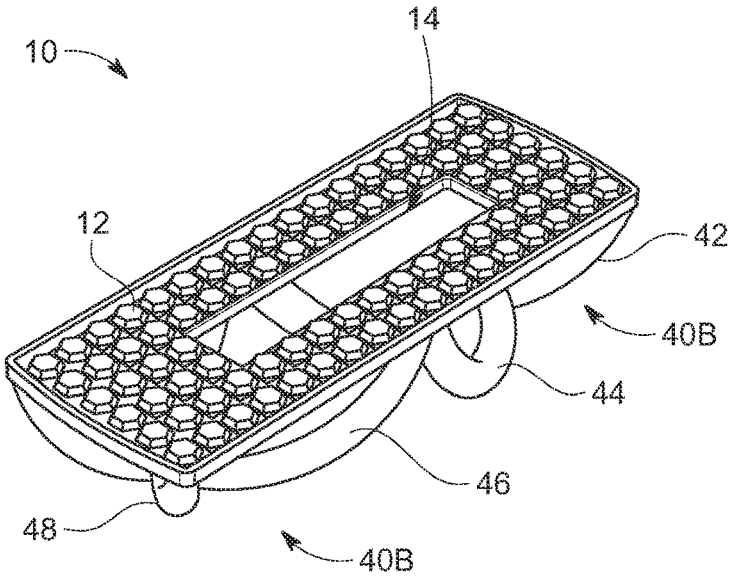
FIG. 4 is an elevated side perspective view of the ring holder of FIG. 1, without the ring and the chain attached thereto.
Figure 5:
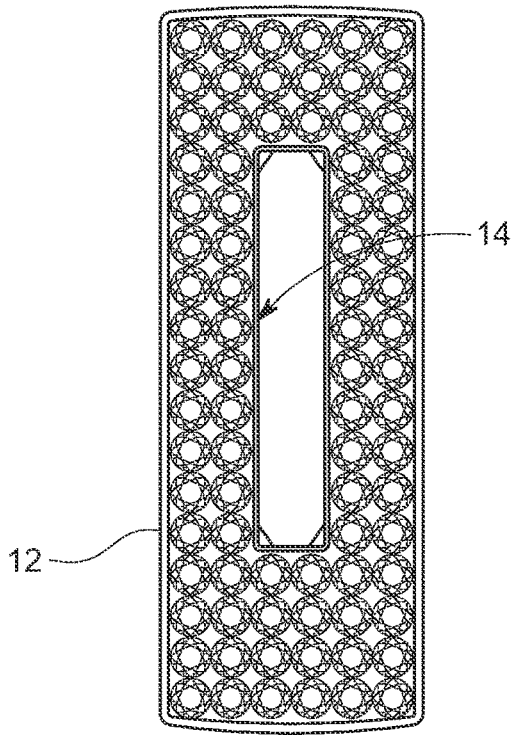
FIG. 5 is a top view of the ring holder of FIG. 1.

FIGS. 1-6 illustrate an exemplary embodiment of a wearable jewelry holder or pendant 10. The jewelry holder 10 generally includes a main body 12 with a jewelry through hole 14, e.g., ring slot 14, and bracing members 42, 44, 46, 48 (FIG. 4). The jewelry holder 10 is configured to be worn about the body of a wearer, such as around one's neck or wrist, and showcase a jewelry item 20 therein. The jewelry holder 10 can be configured a ring holder 10 for showcasing a ring 20. The ring 20 can have a gemstone 22, a shank 24 composed of upper and lower portions 24A, 24B, and a finger through hole 26 as defined by the shank 24. Furthermore, the jewelry holder 10 may also house and showcase one or more auxiliary gemstones (unnumbered).

Upon insertion of a jewelry item 20 and a wearable chain 30 into the ring holder 10, the ring holder 10 automatically securely mounts the jewelry item 20, orients and retains the jewelry item 20 in an upright orientation, and rigidly secures the collective body of the ring holder 10 and jewelry item 20 together on the chain 30 at a particular, adjustable, and fixed location of the chain 30. In other words, the structural interaction of the body of the jewelry item 20, the main body 12 of the ring holder 10, the bracing members 42, 44, and the chain 30 collectively hold the jewelry item 20 upon insertion of the jewelry item 20 in the jewelry through hole 14 and insertion of the chain 30 through a hole in the body of the jewelry item 20 and the bracing members 42, 44. Due to gravity, the jewelry item 20 applies a downward force on the chain 30 which pinches the chain 30 in between the jewelry item 20 and the bracing members 42, 44 to dually rigidly secure the main body 12 to the chain 30 and showcase the jewelry item 20 in an upright and forward-facing position. Additionally, the jewelry holder 10 also protects the jewelry item 20 because the jewelry holder 10 extends beyond the bounds of the jewelry item 20, forming a protective perimeter wall around the jewelry item 20.

Conventional pendants fail to orient a jewelry item in a position which showcases its beauty. For instance, conventional pendants allow a ring to drop downwardly and forwardly, due to gravity. Also, conventional pendants do not fix the ring and body of the pendant at a particular and adjustable location on the chain. In contrast thereto, the jewelry holder 10 seamlessly mounts and desirably orients a jewelry item 20 so that it is securely held and positioned upwardly and outwardly in front of the jewelry holder 10, allowing the jewelry item 20 to be seen and appreciated by the wearer and others (FIGS. 2-3). Hence, when worn around the neck, the wearer may look down and see the gemstone 22 of the ring 20.

The main body 12 comprises a front surface 12A, a back surface 12B, and the jewelry through hole 14 which extends through the main body 12 from the front surface 12A to the back surface 12B. The jewelry through hole 14 is configured to receive the jewelry item 20 therethrough. The jewelry through hole 14 may correspond in size and shape to a particular jewelry item 20. For instance, the ring slot 14 may have a rectangular cross-section that corresponds in size to a particular ring size or outer circumference thereof. However, the jewelry through hole 14 may have any desired size and shape for receiving any desired jewelry item 20 therethrough. In some embodiments, the lower bound of the jewelry through hole 14 may not contact and support the jewelry item 20. Alternatively, in some embodiments, the lower bound of the jewelry through hole 14 may contact and support the jewelry item 20 for mechanically locking the jewelry item 20. For instance, with respect to a ring 20, the shank 24 of the ring may contact the inner perimeter of the ring slot 14 and the chain 30 may extend through the finger hole 26, which applies an upward force one the lower portion 24B of the shank 24 such that the ring is mechanically locked in between the ring slot 14 and the bracing members 42, 44.

Figure 1:
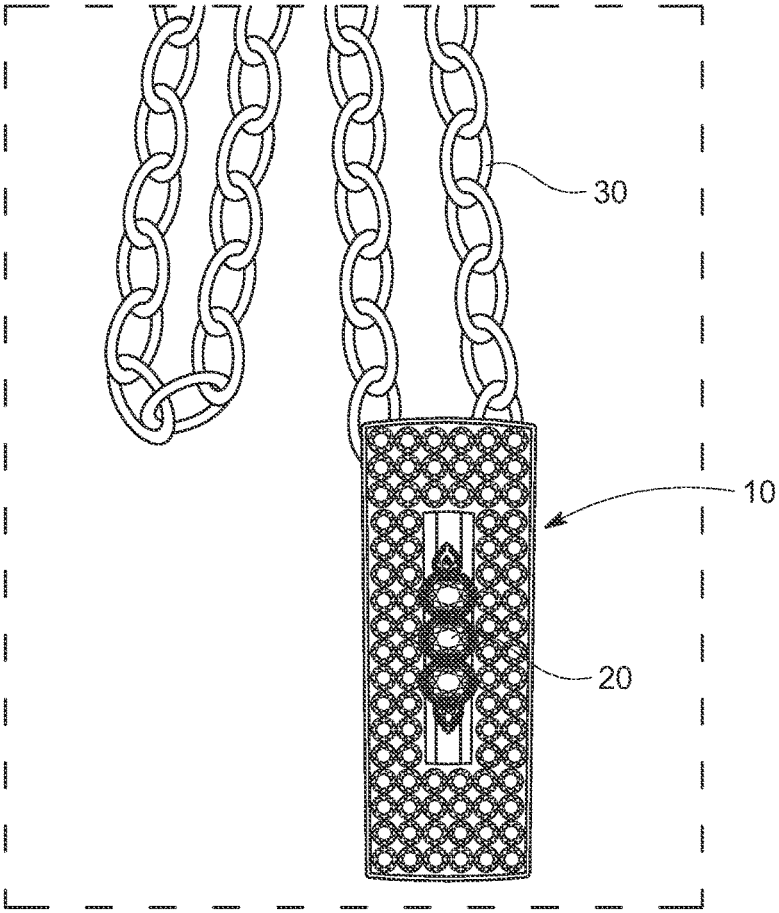
FIG. 1 illustrates a top perspective view of an exemplary embodiment of a ring holder with a ring and a chain attached thereto.

The jewelry holder 10 may include one or more bracing members 42, 44, 46, 48 connected to the back surface 12B of the main body 12. As shown, the jewelry holder 10 has first and second, i.e., upper or primary, bracing members 42, 44 connected to the back surface 12B and defining respective chain through holes 50. The jewelry holder 10 also has third and fourth, i.e., lower or auxiliary, bracing members 46, 48 connected to the back surface 12B, underneath the first and second bracing members 42, 44 as shown in FIG. 3. The third and fourth bracing members 46, 48 also define through holes 52 which may or may not be used to receive the chain 30 therethrough. In the present embodiment, the through holes 52 of the third and fourth bracing members 46, 48 do not receive the chain 30 (FIGS. 1-2).

Figure 6:
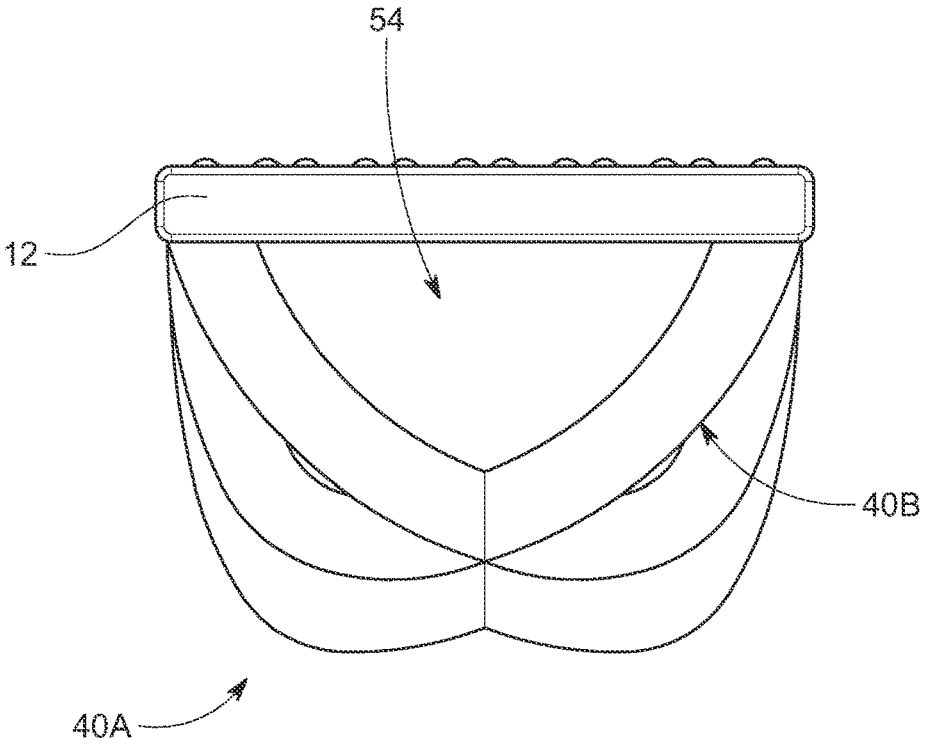
FIG. 6 is a front side view of the ring holder of FIG. 1.
Figure 7:
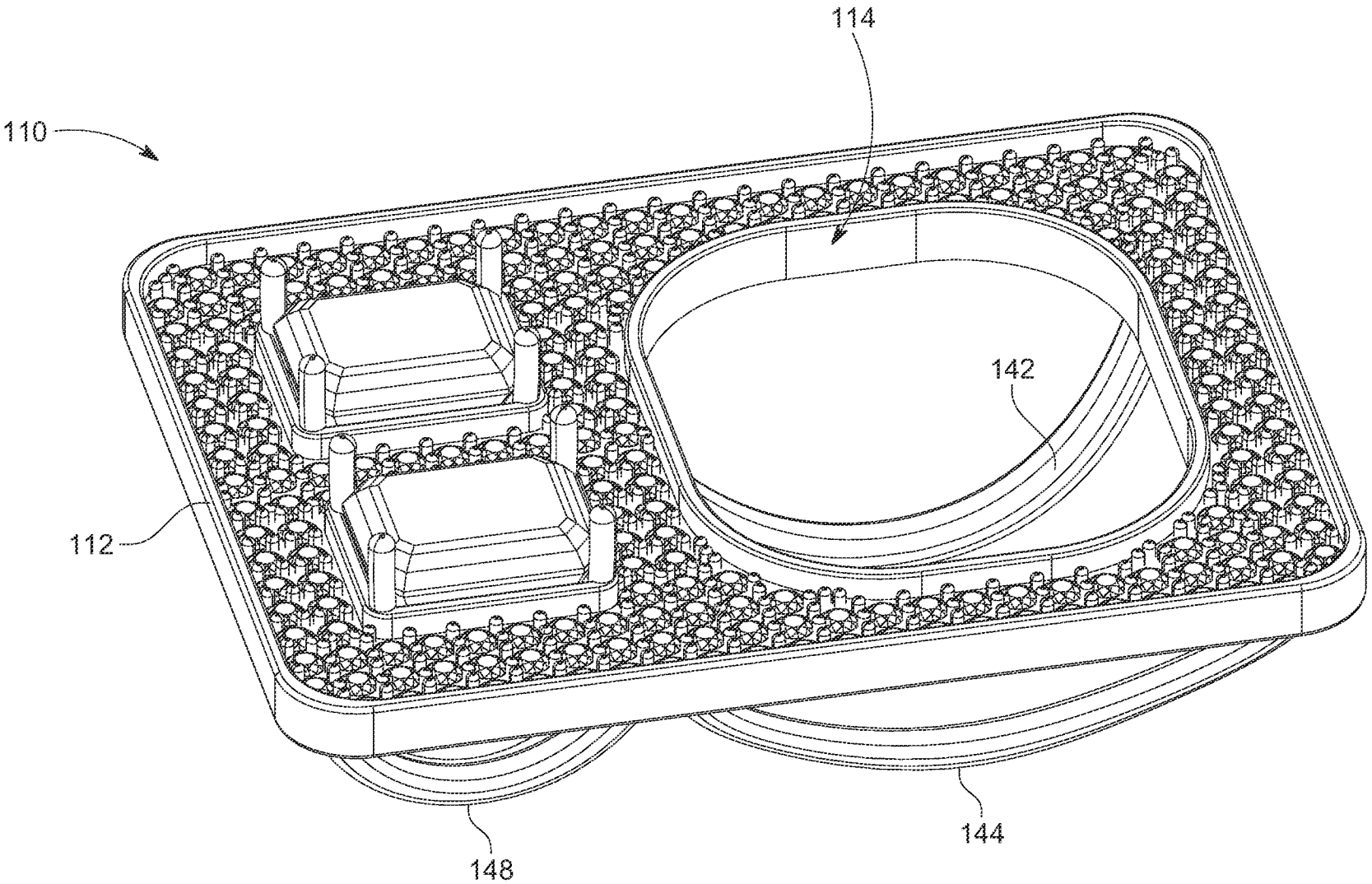
FIG. 7 is an elevated side perspective view of another exemplary embodiment of a ring holder.
Figure 8:
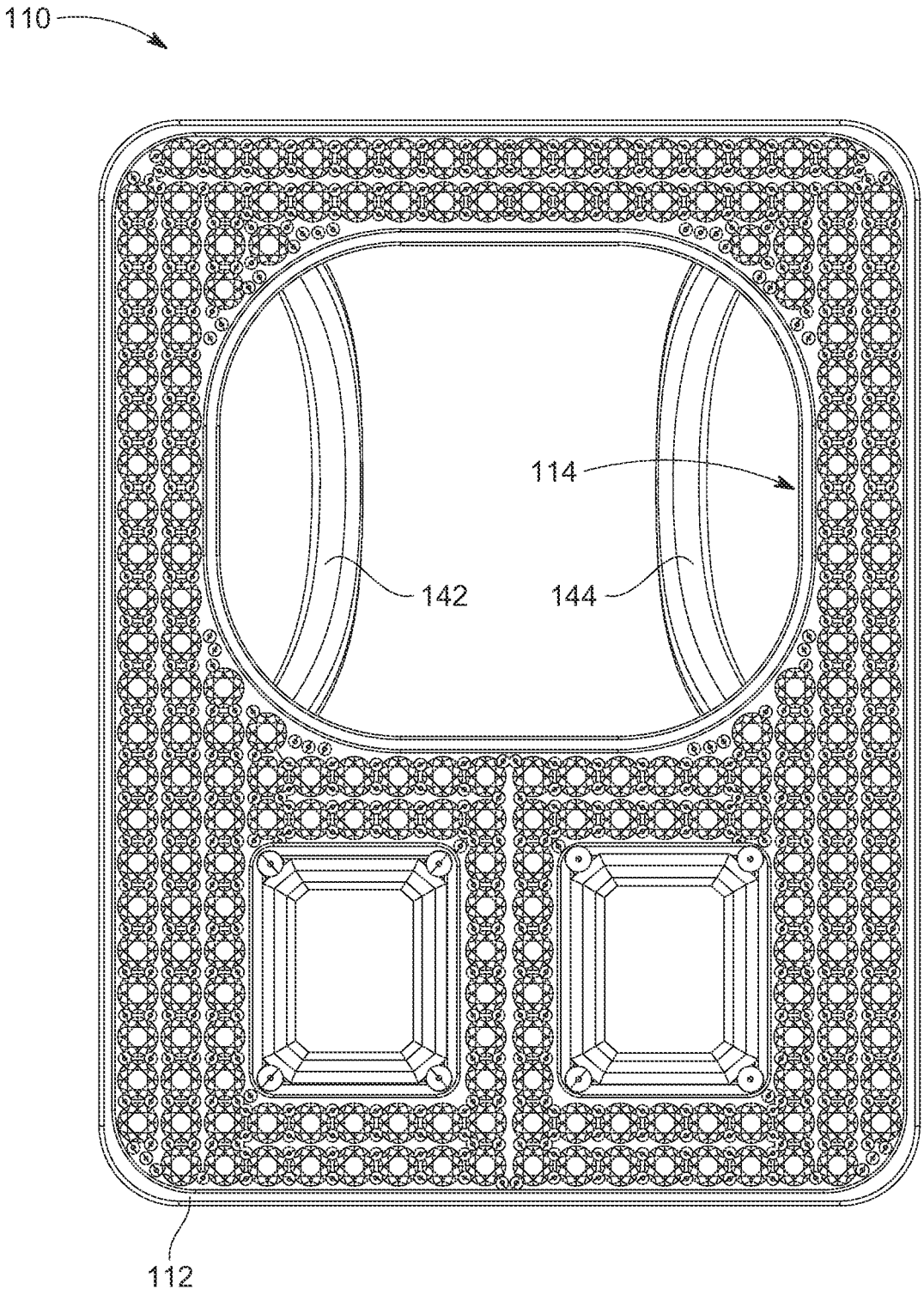
FIG. 8 is a top view of the ring holder of FIG. 7.

The bracing members 42, 44, 46, 48 are respectively located adjacent to the first and second sides of the main body 12. The bracing members 42, 44, 46, 48 are spaced apart from one another at a distance such that a gap 54 is defined therebetween (FIG. 6). This gap 54 receives a rear portion of the jewelry item 20, such as the lower shank 24B of the ring 20. The first and second chain through holes 50 flank either side of the rear portion of the jewelry item 20, and the through hole 26 thereof. As shown, the bracing members 42, 44, 46, 48 are connected to, i.e., conjoined with, one another. Each bracing member defines 42, 44, 46, 48 an arched brace 42, 44, 46, 48 that is connected to one another and accordingly defines an X-shaped arched brace 40A, 40B. In other words, each bracing member 42, 44, 46, 48 is a semi-circular or half loop 42, 44, 46, 48 that crisscrosses with its juxtaposed loop 42, 44, 46, 48. The arched braces 42, 44 define a primary X-shaped arched brace 40A, and the arched braces 46, 48 define an auxiliary X-shaped arched brace 40B. Each arched brace 42, 44, 46, 48 has a base 56, or proximal ends, that is connected to the back surface 12B of the main body 12 and an apex 58 (FIG. 3).

The bracing members 42, 44 are configured to contact the wearer when the jewelry holder 10 is worn on the wearer. The bracing members 46, 48 may or may not be configured to contact the wearer when the jewelry holder 10 is worn on the wearer. In the present embodiment, the bracing members 42, 44, 46, 48 are configured to contact the wearer during use and each one assists in holding a relatively upright position of the jewelry holder 10 which in turn holds the jewelry 20 item upright. The bottom of the jewelry item 20 may or may not contact the wearer during use. In other words, the bracing members 42, 44, 46, and/or 48 may or may not extend beyond the bottom of the jewelry item 20 when it is seated within the main body 12.

FIGS. 7-10 illustrate another exemplary embodiment of a jewelry holder 110. The jewelry holder 110 can be substantially similar to the jewelry holder 10, except that the jewelry holder 110 is differently configured to receive a larger jewelry item. More particularly, the jewelry holder 110 has a larger jewelry through hole 114 which extends transversely to the longitudinal axis of the main body 112 and separate, i.e., non-conjoined, bracing members 142, 144, 146, 148. Additionally, the jewelry holder 110 may have additional auxiliary bracing members 170, 172 which correspond to the bracing members 146, 148 and the gemstones (unnumbered) held within the main body. Like elements have been identified with like reference characters, except for the 100 series designation.

Each arched brace 142, 144, 146, 148, 170, 172 has a taper such that it tapers inwardly toward a middle of the main body 112 as it extends outwardly from its base 156 at the back surface 112B of the main body 112 to its apex 158

Figure 9:
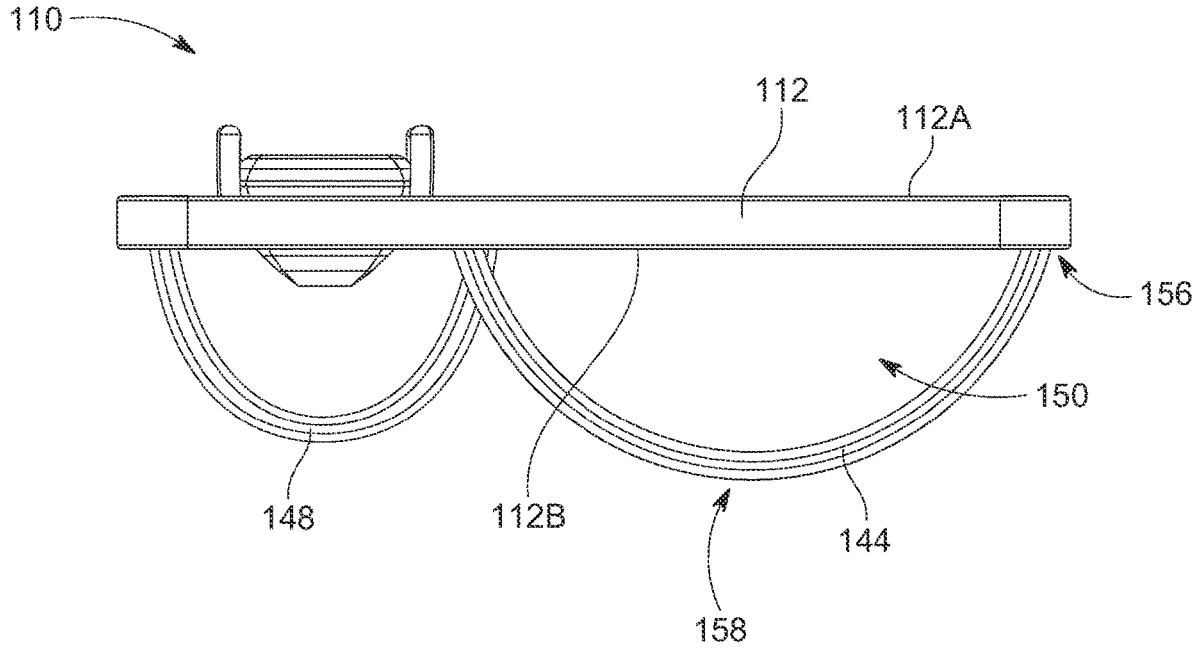
FIG. 9 is a side view of the ring holder of FIG. 7.
Figure 10:
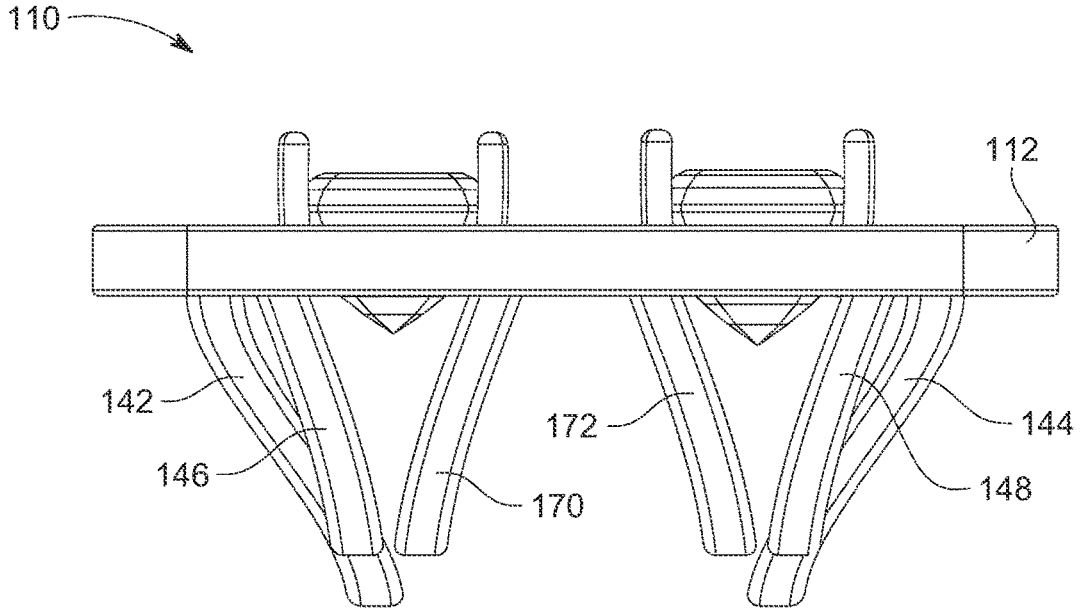
FIG. 10 is a front side view of the ring holder of FIG. 7.

(FIGS. 9-10). The taper of each arched brace 142, 144 is configured to correspond to a surface contour of the jewelry item 20. In more detail, the taper matches the profile of the shank of a given ring. The taper reduces the space between the arched brace 142, 144 and the shank of the ring for substantially immobilizing the ring. Each arched brace 142, 144 may or may not contact the jewelry item 20.

Figure 11:
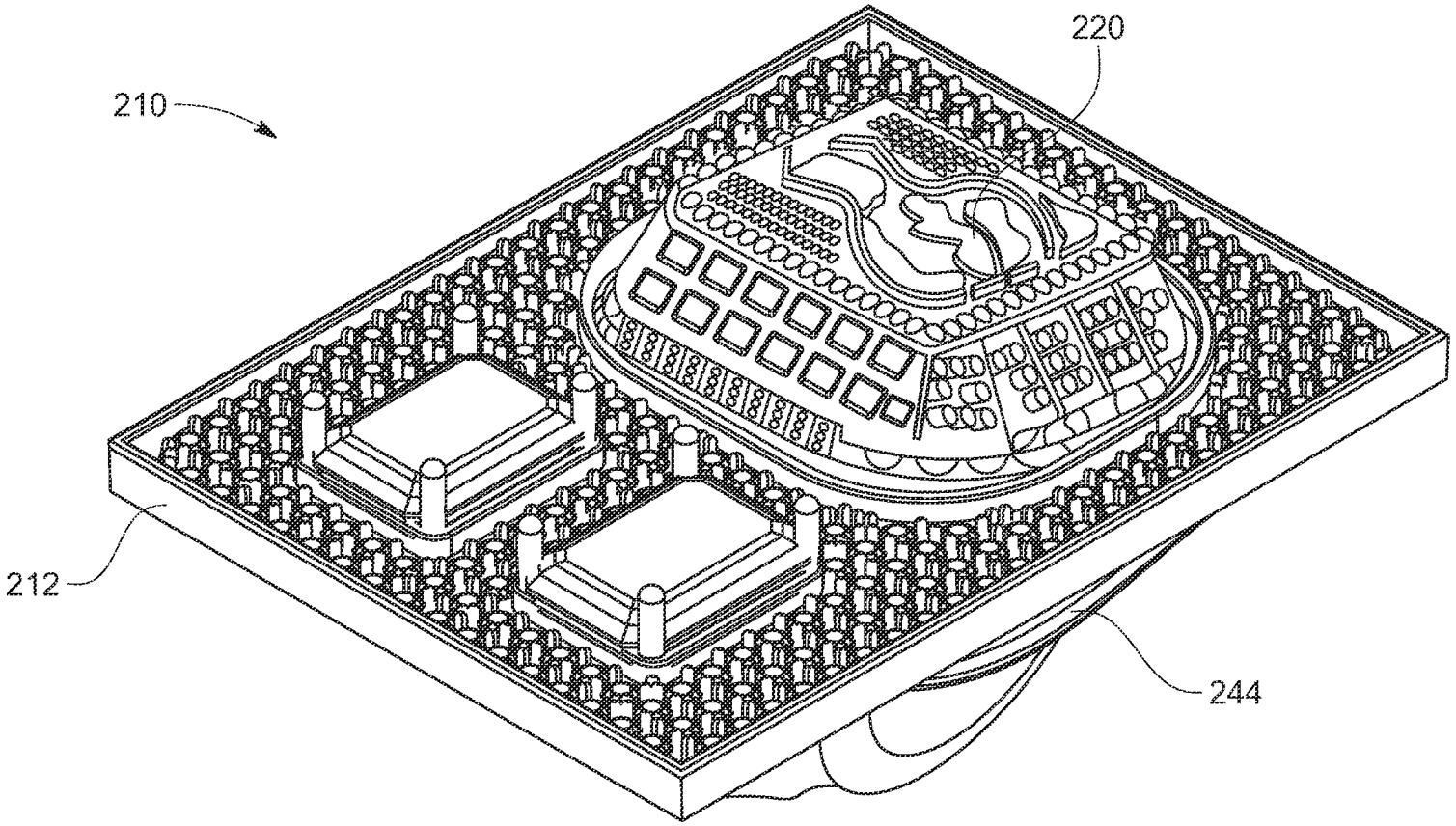
FIG. 11 is an elevated side perspective view of another exemplary embodiment of a ring holder, with a ring disposed therein.
Figure 12:
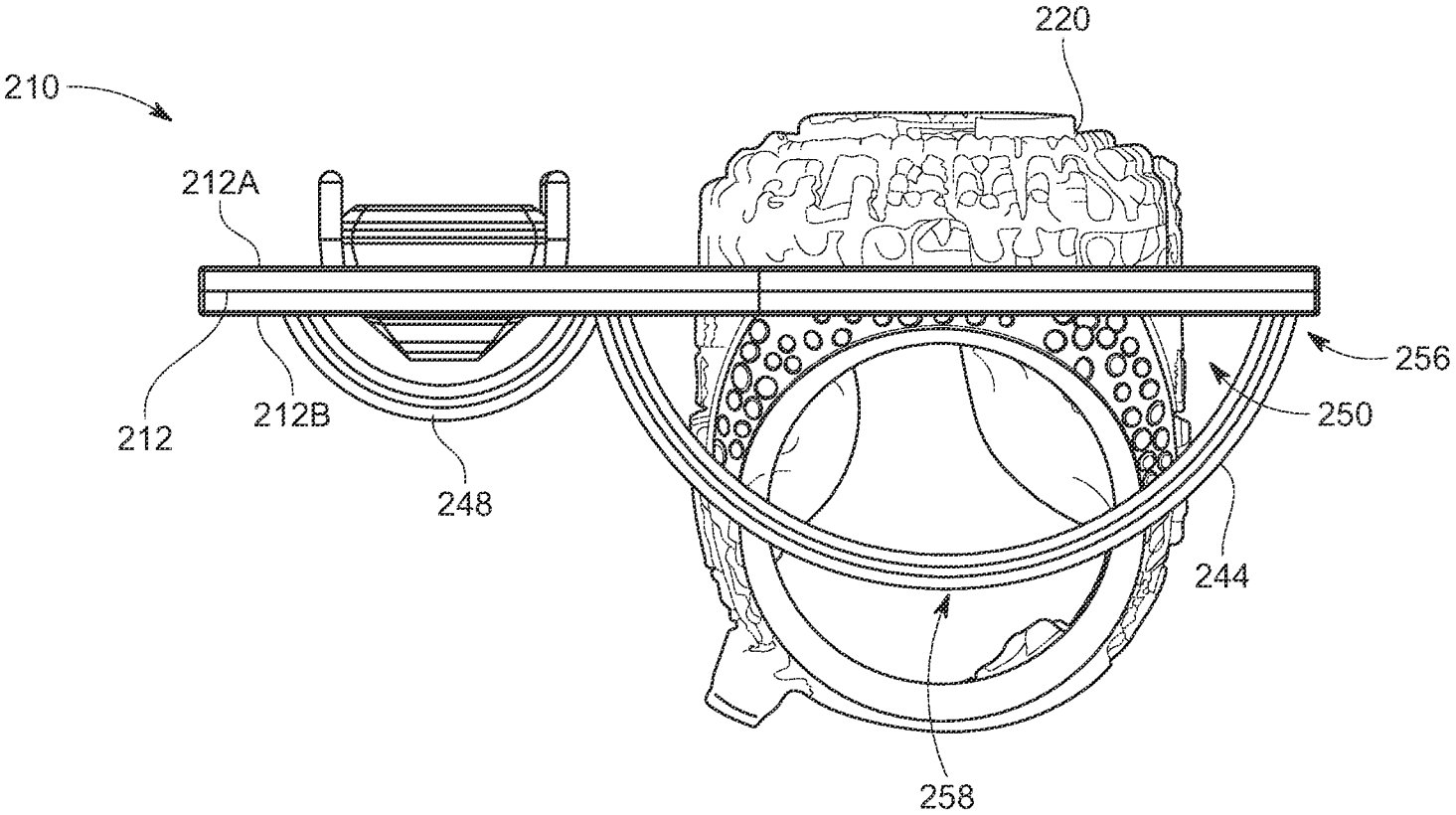
FIG. 12 is a side view of the ring holder of FIG. 11.
Figure 13:
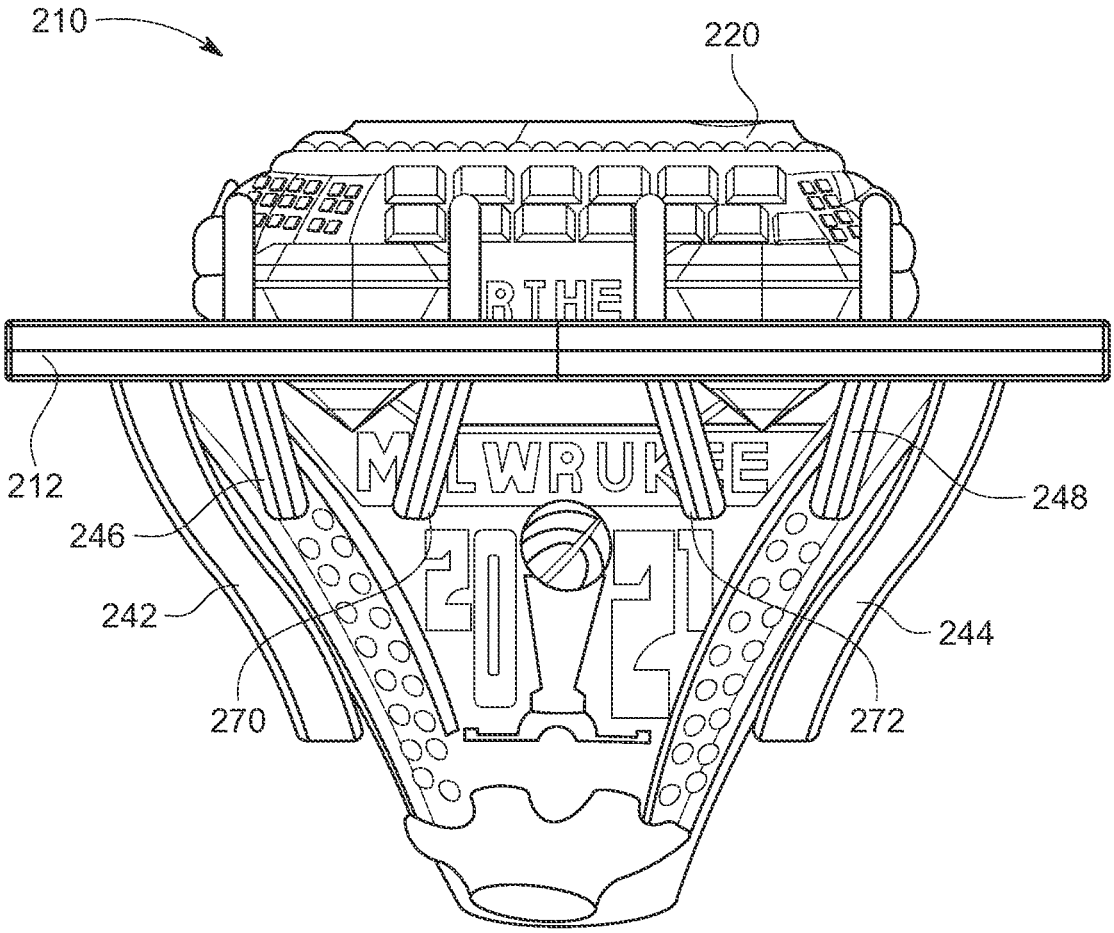
FIG. 13 is a front side view of the ring holder of FIG. 11.

FIGS. 11-13 illustrate another exemplary embodiment of a jewelry holder 210. The jewelry holder 210 can be substantially similar to the jewelry holders 10, 110, except that the jewelry holder 210 has smaller auxiliary bracing members 246, 248, 270, 272. Like elements have been identified with like reference characters, except for the 200 series designation.

The auxiliary bracing members 246, 248, 270, 272 can be associated with respective gemstones held within the gemstone through holes (not shown) in the main body 212. Each auxiliary bracing member 246, 248, 270, 272 may extend outwardly away from the back surface 212B of the main body 212 up to one half of the radius of each primary bracing member 242, 244. Each bracing member 242, 244 246, 248, 270, 272 may or may not be configured to contact the wearer. In the present embodiment, each bracing member 242, 244 246, 248, 270, 272 does not contact the wearer and instead the bottom of the jewelry item contacts the wearer.

Figure 14:
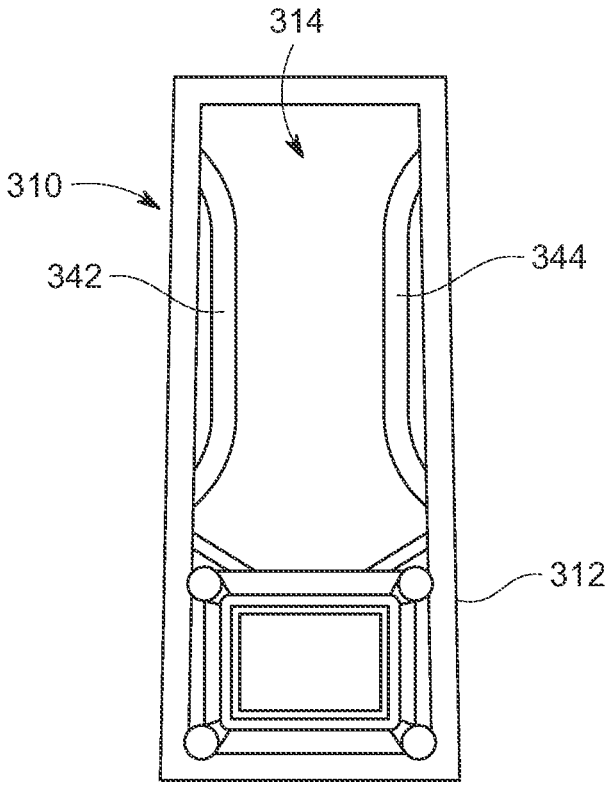
FIG. 14 is a top perspective view of another exemplary embodiment of a ring holder.
Figure 15:
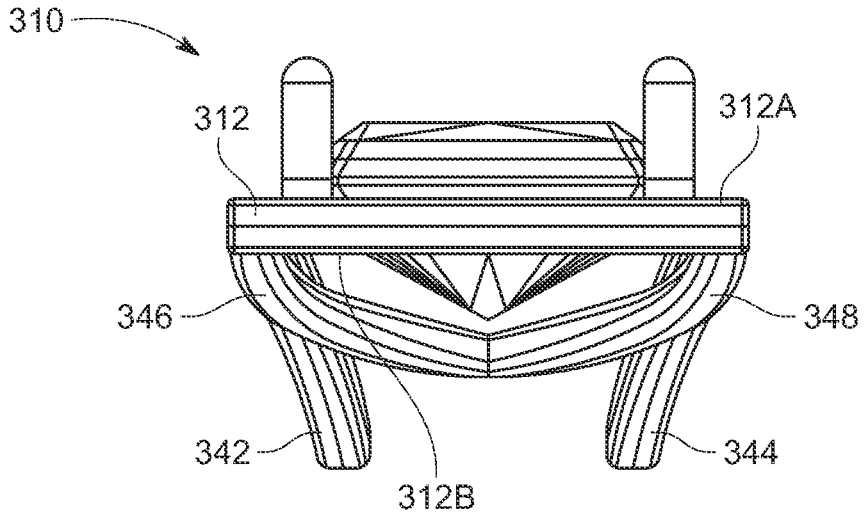
FIG. 15 is a front side view of the ring holder of FIG. 14.

FIGS. 14-15 illustrate another exemplary embodiment of a jewelry holder 310. The jewelry holder 310 can be substantially similar to the jewelry holders 10, 110, 210, except that the jewelry holder 310 has a differing main body 312, with a differing and larger jewelry through hole 314, and bracing members 342, 344 for receiving a corresponding jewelry item 20 therethrough. Like elements have been identified with like reference characters, except for the 300 series designation.

The main body 312 has a jewelry through hole 314 which occupies a substantial amount of the surface area of the main body 312. The main body 312 may comprise an outer perimeter wall that defines the jewelry through hole 314. The main body 312 may also include a gemstone through hole and corresponding holding members for mounting a gemstone therein (unnumbered). The jewelry through hole 314 allows the wearer to insert a larger jewelry item, whilst having a reduced profile main body 312 similar to the main body 12 of the jewelry holder 10 of FIGS. 1-6.

To receive a larger jewelry item therein, the jewelry holder 310 has separate, i.e., non-conjoined, primary bracing members 342, 344. The primary bracing members 342, 344 flank each side of the jewelry item. The jewelry holder 310 also has conjoined, i.e., X-shaped, auxiliary bracing members 346, 348. The bracing members 342, 344, 346, 348 may or may not be configured to contact the wearer.

Any of the jewelry holders 10, 110, 210, 310 may be used according to the following method. The user may select a jewelry holder that fits her jewelry item. For example, a ring holder 10 may be provided that has a ring slot and bracing members that correspond to the size and shape of the ring. The user may insert the ring into the ring through hole such that a shank of the ring extends therethrough. In more detail, the user may slide the ring through the front of the ring holder with the gemstone of the ring facing forward, sliding the ring backwards into the ring holder. Thereafter, the user may insert the chain 30 through the first chain through hole, the finger through hole of the ring, and the second chain through hole such that the main body and the bracing members collectively hold the ring. Then, the collective unit of the ring holder, the ring, and the chain 30 may be donned by the wearer. Due to gravity, the ring applies a downward force on the chain 30 which pinches the chain 30 in between the ring and the bracing members to dually rigidly secure the main body to the chain 30 and showcase the ring in an upright and forward-facing position.

The jewelry holder may be comprised of any desired material. The materials of manufacture are not particularly limited. Generally, the jewelry holder may be manufactured from a metal, plastic, wood, carbon composite, etc. The jewelry holder may be cast as one unitary piece or as separate pieces joined by fasteners, adhesives, welding or the like. For instance, the pendent may be comprised of a metal plate with cutout therein, semi-circular loops attached to the back of the plate via soldering, and gemstones attached to the front of the metal plate.

It is contemplated that the forward-facing surface of the pendant may have an ornamental treatment such as gemstones or other ornate design. Gemstones could also be set in alternate places on the pendant. Alternatively, it is also contemplated that the various surfaces of the pendant may not include gemstones or an ornate design and instead feature the natural surface finish of the material of the pendant.

It should be appreciated that the number of ring slots and the dimensions of the ring slot are not particularly limited. As shown, each pendent includes only one ring slot. However, the pendent may include two or more ring slots for accommodating two or more rings therein. Furthermore, the pendent may include any desired number of loops. Additionally, the loops on the back of the pendant are not particularly limited in shape or number.

Other embodiments, which differ from the aforementioned embodiments, may be recognized by those skilled in the art without departing from the scope of the following claims.

The invention claimed is:

1. A wearable jewelry holder, comprising:

a main body comprising a front surface, a back surface, and a jewelry through hole extending through the main body from the front surface to the back surface, the jewelry through hole configured to receive a jewelry item therethrough;

a first bracing member connected to the back surface and defining a first chain through hole; and a second bracing member connected to the back surface and defining a second chain through hole, wherein the main body and the first and second bracing members are collectively configured to hold the jewelry item upon insertion of the jewelry item in the jewelry through hole and insertion of a wearable chain through the first chain through hole, a through hole of the jewelry item, and the second chain through hole.

2. The wearable jewelry holder of claim 1, wherein the jewelry item applies a downward force on the chain which pinches the chain in between the jewelry item and the first and second bracing members to dually rigidly secure the main body to the chain and showcase the jewelry item in an upright position.

3. The wearable jewelry holder of claim 1, wherein the first and second bracing members are configured to contact a wearer when the wearable jewelry holder is worn on the wearer.

4. The wearable jewelry holder of claim 1, wherein:

the first and second bracing members are spaced apart from one another at a distance such that a gap is defined therebetween;

the gap is configured to receive a rear portion of the jewelry item; and the first and second chain through holes flank either side of the rear portion of the jewelry item.

5. The wearable jewelry holder of claim 1, wherein:

the first and second bracing members are connected to one another; and the first and second bracing members together define an X-shaped arched brace.

6. The wearable jewelry holder of claim 1, wherein:

the first bracing member is located adjacent to a first side of the main body;

the first bracing member defines a first arched brace;

the second bracing member is located adjacent to a second side of the main body; and the second bracing member defines a second arched brace.

7. The wearable jewelry holder of claim 6, wherein:

the first arched brace and the second arched brace each comprise a base connected to the back surface of the main body;

the first arched brace and the second arched brace each extend outwardly from the base to an apex thereof; and the first arched brace and the second arched brace each have a taper which is configured to correspond to a surface contour of the jewelry item such that the first arched brace and the second arched brace each taper inwardly toward a middle of the main body, from the base at the back surface of the main body to the apex thereof.

8. The wearable jewelry holder of claim 1, further comprising:

a third bracing member connected to the back surface;

a fourth bracing member connected to the back surface; and the third and fourth bracing members are configured to contact a wearer to maintain an upright position of the main body.

9. A wearable ring holder, comprising:

a main body comprising a front surface, a back surface, and a ring through hole extending through the main body from the front surface to the back surface, the ring through hole configured to receive a shank of a ring therethrough;

a first bracing member connected to the back surface and defining a first chain through hole; and a second bracing member connected to the back surface and defining a second chain through hole, wherein the main body and the first and second bracing members are collectively configured to hold the ring upright upon insertion of the ring in the ring through hole and insertion of a wearable chain through the first chain through hole, a finger through hole of the ring, and the second chain through hole.

10. The wearable ring holder of claim 9, wherein the shank of the ring applies a downward force on the chain which pinches the chain in between the shank of the ring and the first and second bracing members to dually rigidly secure the main body to the chain and showcase the ring in an upright position.

11. The wearable ring holder of claim 9, wherein the first and second bracing members are configured to contact a wearer when the wearable ring holder is worn on the wearer.

12. The wearable ring holder of claim 9, wherein:

the first and second bracing members are spaced apart from one another at a distance such that a gap is defined therebetween;

the gap is configured to receive a rear portion of the shank of the ring; and the first and second chain through holes flank either side of the rear portion of the shank of the ring.

13. The wearable ring holder of claim 9, wherein:

the first and second bracing members are connected to one another; and the first and second bracing members together define an X-shaped arched brace.

14. The wearable ring holder of claim 9, wherein:

the first bracing member is located adjacent to a first side of the main body;

the first bracing member defines a first arched brace;

the second bracing member is located adjacent to a second side of the main body; and the second bracing member defines a second arched brace.

15. The wearable ring holder of claim 14, wherein:

the first arched brace and the second arched brace each comprise a base connected to the back surface of the main body;

the first arched brace and the second arched brace each extend outwardly from the base to an apex thereof; and the first arched brace and the second arched brace each have a taper which is configured to correspond to a surface contour of the ring such that the first arched brace and the second arched brace each taper inwardly toward a middle of the main body, from the base at the back surface of the main body to the apex thereof.

16. The wearable ring holder of claim 9, further comprising:

a third bracing member connected to the back surface;

a fourth bracing member connected to the back surface; and the third and fourth bracing members are configured to contact a wearer to maintain an upright position of the main body.

17. A method, comprising:

providing a ring with a finger through hole, a wearable chain, and a wearable ring holder, the wearable ring holder including a main body having a front surface, a back surface, and a ring through hole extending through the main body from the front surface to the back surface, a first bracing member connected to the back surface and defining a first chain through hole, and a second bracing member connected to the back surface and defining a second chain through hole;

inserting the ring into the ring through hole such that a shank of the ring extends therethrough; and inserting the chain through the first chain through hole, the finger through hole of the ring, and the second chain through hole such that the main body and the first and second bracing members collectively hold the ring.

18. The method of claim 17, further comprising a step of:

wearing the chain, the ring, and the wearable ring holder, wherein the ring applies a downward force on the chain which pinches the chain in between the ring and the first and second bracing members to dually rigidly secure the main body to the chain and showcase the ring in an upright position.

19. The method of claim 17, wherein the first and second bracing members are configured to contact a wearer when the wearable ring holder is worn on the wearer.

20. The method of claim 17, wherein:

the first and second bracing members are spaced apart from one another at a distance such that a gap is defined therebetween;

the gap is configured to receive a rear portion of the ring; and the first and second chain through holes flank either side of the rear portion of the ring.

* * * * *